US006732557B1

(12) United States Patent
Zehrung

(10) Patent No.: US 6,732,557 B1
(45) Date of Patent: May 11, 2004

(54) ELECTRIFIED MORTISE LOCK HAVING A SOLENOID CRADLE

(76) Inventor: Raymond E. Zehrung, 131 Serena Way, Santa Clara, CA (US) 95051

( * ) Notice: Subject to any disclaimer, the term of this patent is extended or adjusted under 35 U.S.C. 154(b) by 0 days.

(21) Appl. No.: 10/077,323

(22) Filed: Feb. 15, 2002

(51) Int. Cl.[7] ..... E05B 47/06

(52) U.S. Cl. ..... 70/283; 70/277; 70/462; 70/466; 248/671; 248/674

(58) Field of Search ..... 70/280–283, 277, 70/278.7, 278.6, 448, 451, 461, 462, 466; 292/DIG. 53; 408/241 B, 115 R, 115 B; 403/13, 14; 248/671, 674, 676, 678

(56) References Cited

U.S. PATENT DOCUMENTS

| | | | | | |
|---|---|---|---|---|---|
| 4,118,056 | A | | 10/1978 | Alexander | 292/169 |
| 4,373,826 | A | * | 2/1983 | Inamoto et al. | 403/14 |
| 4,583,382 | A | | 4/1986 | Hull | 70/170 |
| 4,844,645 | A | * | 7/1989 | Rasmussen | 403/14 |
| 4,950,005 | A | | 8/1990 | Cudd | 292/169 |
| 5,116,170 | A | * | 5/1992 | Palmer et al. | 408/72 B |
| 5,222,845 | A | * | 6/1993 | Goldstein et al. | 408/103 |
| 5,228,730 | A | | 7/1993 | Gokcebay et al. | 292/144 |
| 5,230,592 | A | * | 7/1993 | Degen et al. | 408/115 R |
| 5,246,258 | A | * | 9/1993 | Kerschenbaum et al. | 292/144 |
| 5,290,005 | A | * | 3/1994 | Akiyama et al. | 248/671 |
| 5,308,107 | A | * | 5/1994 | Watanabe et al. | 403/14 |
| 5,474,348 | A | | 12/1995 | Palmer et al. | 292/339 |
| 5,475,996 | A | * | 12/1995 | Chen | 70/279.1 |
| 5,569,001 | A | * | 10/1996 | Brutscher et al. | 404/115 R |
| 5,791,177 | A | * | 8/1998 | Bianco | 70/283.1 |
| 5,876,073 | A | * | 3/1999 | Geringer et al. | 292/144 |
| 6,131,966 | A | | 10/2000 | Hensley et al. | 292/139 |
| 6,434,985 | B1 | * | 8/2002 | Walmsley | 70/277 |

* cited by examiner

*Primary Examiner*—John B. Walsh
(74) *Attorney, Agent, or Firm*—David R. Gildea

(57) ABSTRACT

An electrified mortise lock where the same method and articles can be used for electrifying the mortise locks of many manufacturers and styles. The electrified mortise lock includes a solenoid and a cradle. The cradle includes a frame for embracing the solenoid and cradle pins for fixing the solenoid to a housing.

19 Claims, 5 Drawing Sheets

ELECTRIFIED MORTISE LOCK HAVING A SOLENOID CRADLE

BACKGROUND OF THE INVENTION

1. Field of the Invention

Figure 1:
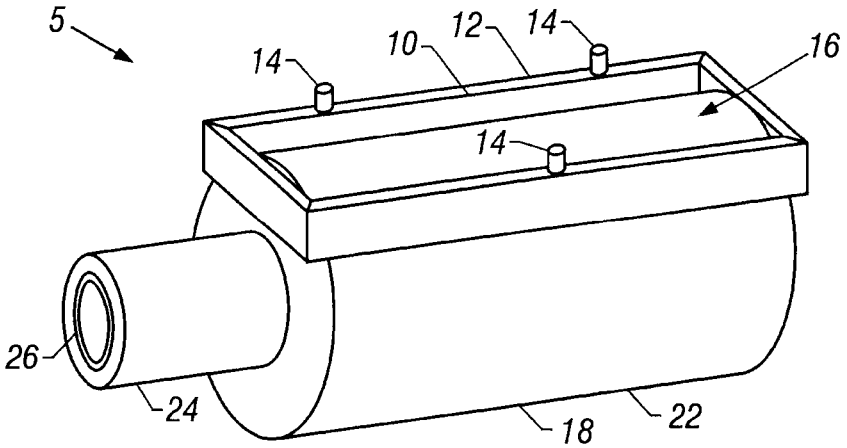

The invention relates generally to electrified mortise locks and more particularly to an electrified mortise lock having a solenoid cradle for enabling the same solenoid to be fixed into the housings of a multiplicity of styles of mortise locks.

2. Description of the Prior Art

A mortise lock is a lock fitting into a mortise of a door or the like so that the lock is covered on both sides by door material. Electrified mortise locks are well known for door hardware and usually include a solenoid or a motor for locking or unlocking a handle. When the handle is locked, a mechanism in the mortise lock drives a latch outward to engage a door strike. When the solenoid or motor unlocks the handle, the handle can be turned in order to retract the latch so that the door can be pushed or pulled open. Typically, the latch can also be retracted with a key override that operates through the mechanism. A standard mortise lock has a width to fit into a one and one quarter inch wide mortise hole in the edge of the door. However, within this standard there are many manufacturers and styles of such locks.

There is a need by manufacturers, installers and users of non-electrified mortise locks to convert non-electrified locks into electrified locks. Unfortunately, to date the schemes for making such conversions have required expensive manufactured articles and machine operations. Moreover, each one of such schemes has been limited to one or only a few manufacturers and styles.

SUMMARY OF THE INVENTION

It is therefore an object of the present invention to provide a simple method and an inexpensive solenoid cradle for electrifying mortise door locks where the same method and cradle can be used for mortise locks of many manufacturers and styles.

Briefly, in a preferred embodiment, the present invention is an electrified mortise lock kit including a solenoid cradle and a solenoid. In another preferred embodiment, the present invention is an electrified mortise lock including the solenoid cradle and the solenoid of the kit; and a mechanism, a handle, a latch, and a housing. The solenoid cradle includes a frame for embracing the solenoid and cradle pins for fixing the frame, and thereby fixing the solenoid, in the housing. The solenoid includes an armature for engaging the solenoid to the mechanism for alternatively unlocking or locking the handle. The solenoid is end-for-end reversible without removing the cradle from the housing for providing fail secure or fail non-secure operation. The same solenoid and cradle is used with the mechanisms, latches and housings for many manufacturers and styles. Conversion of a non-electrified mortise lock to an electrified mortise lock requires removing parts of the mechanism not needed for electrified operation and using a simple hand drill for drilling cradle mounting holes in the housing.

These and other objects and advantages of the present invention will no doubt become obvious to those of ordinary skill in the art after having read the following detailed description of the preferred embodiments which are illustrated in the various figures.

IN THE DRAWINGS

Figure 2A:
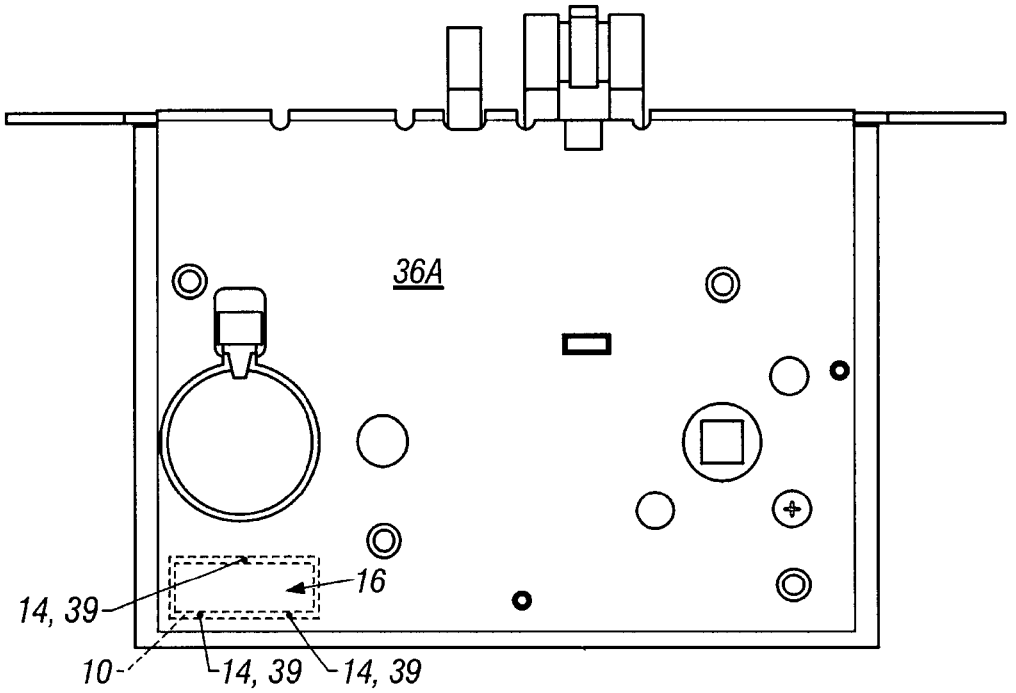
Figure 2B:
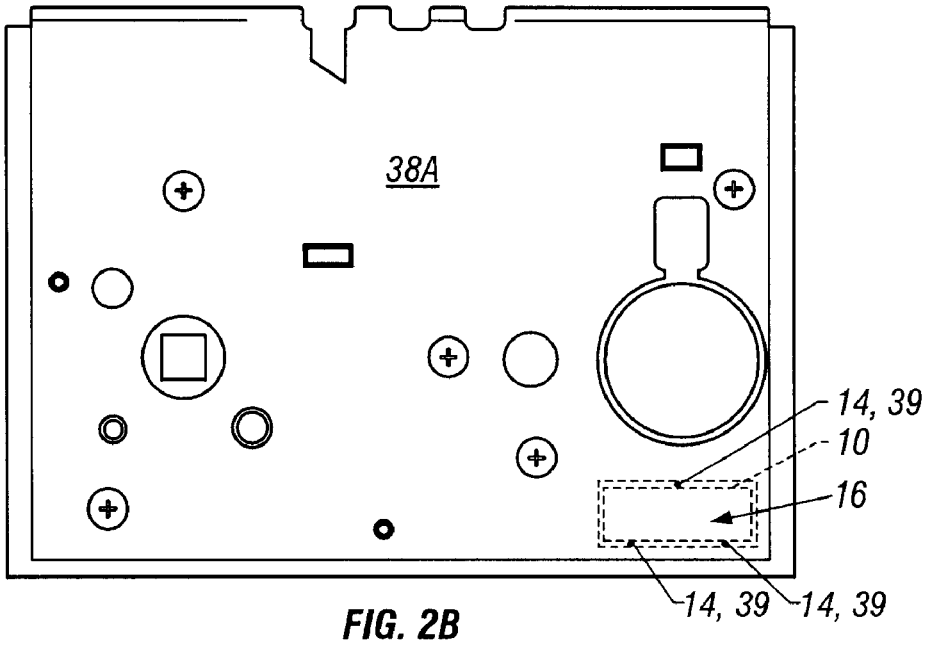
Figure 3A:
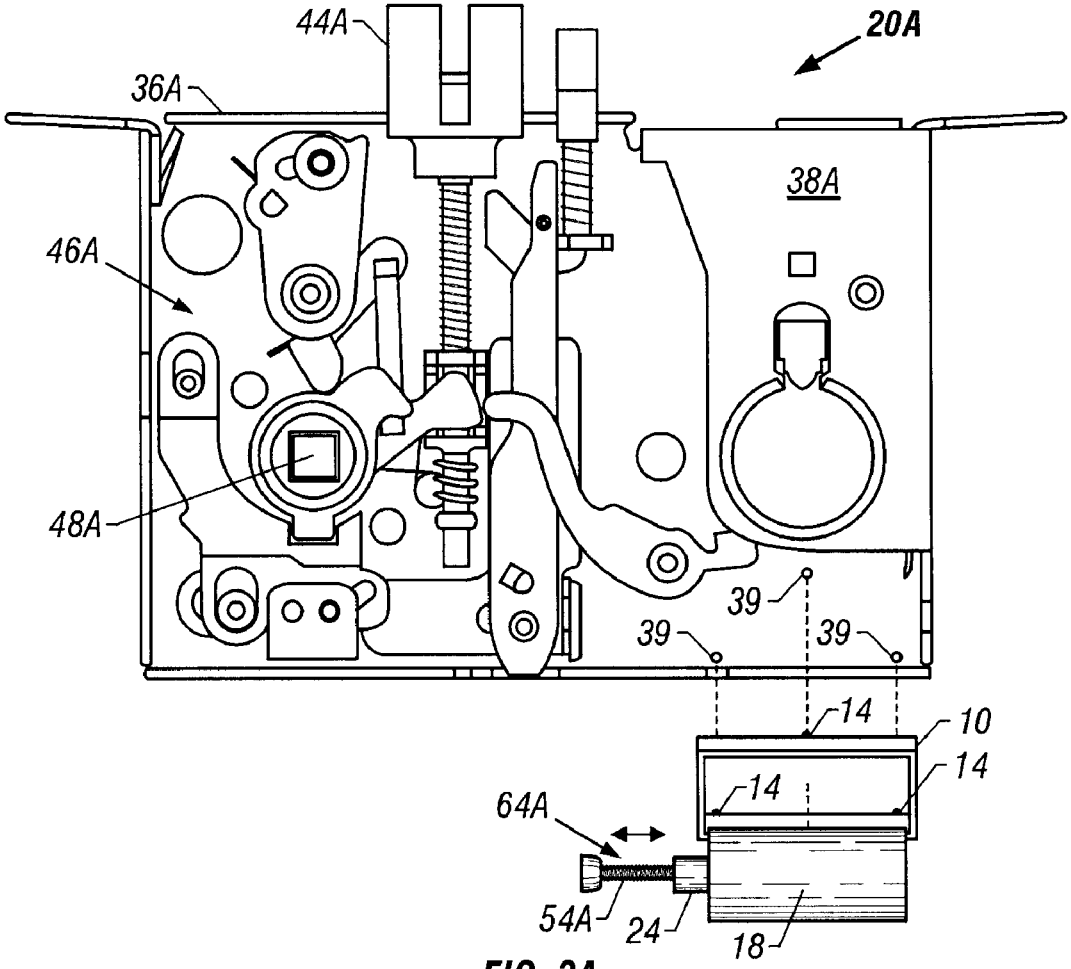
Figure 3B:
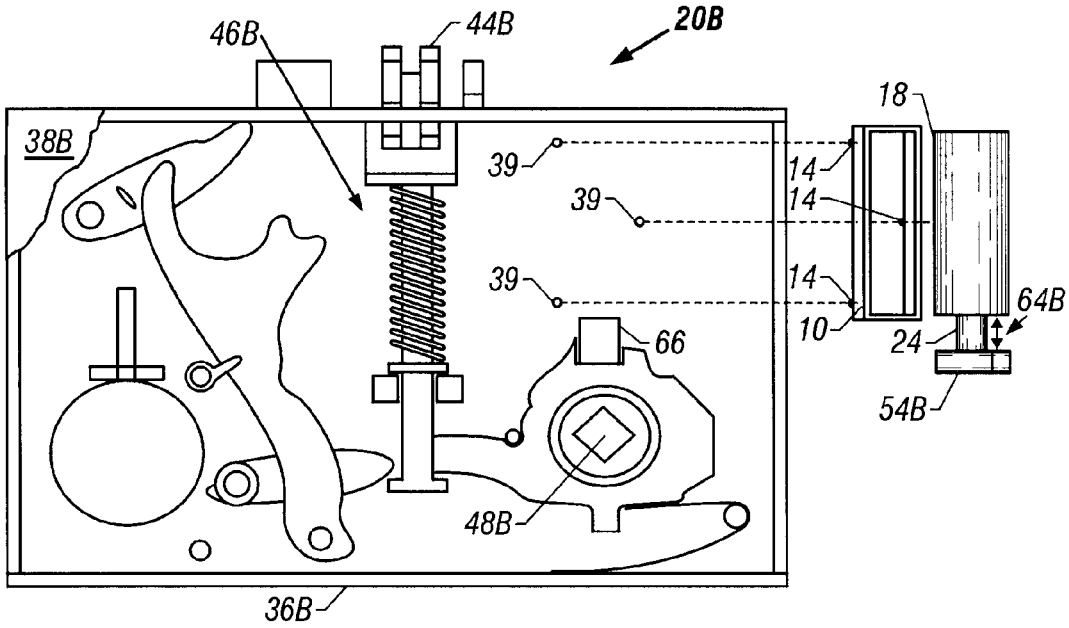
Figure 3D:
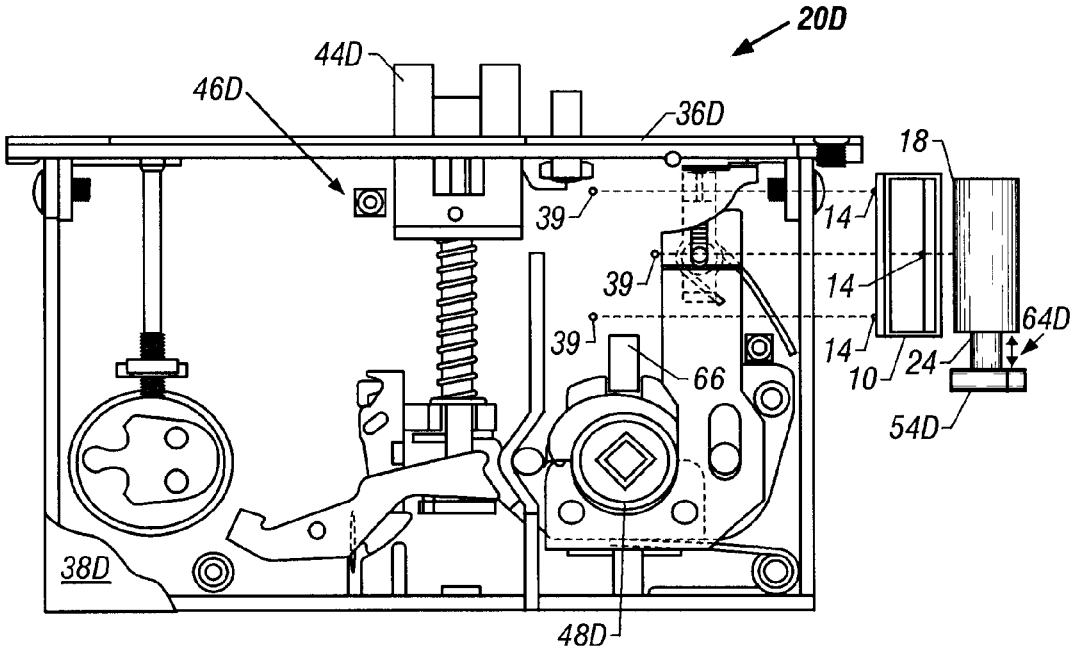
Figure 3C:
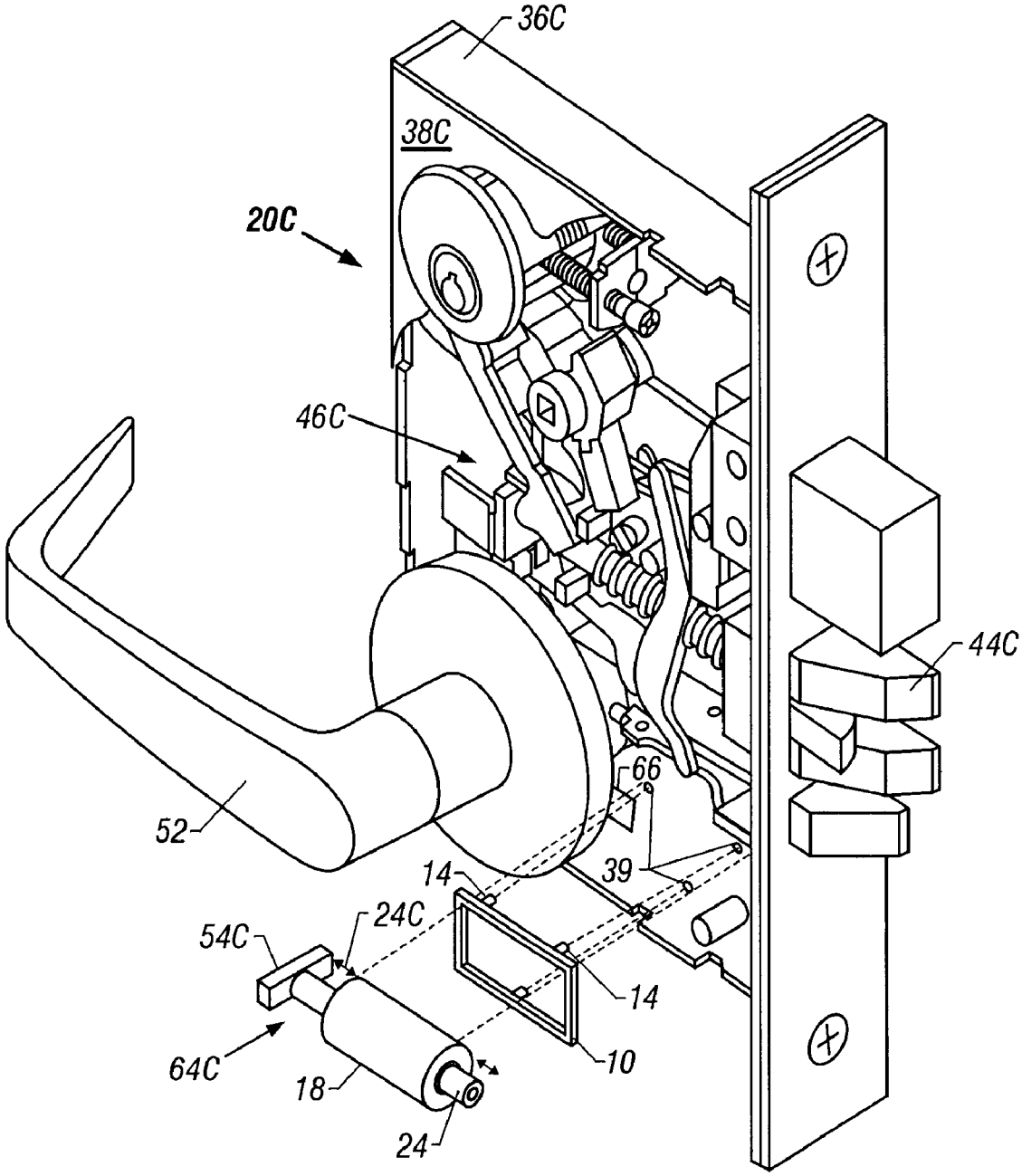
Figure 4:
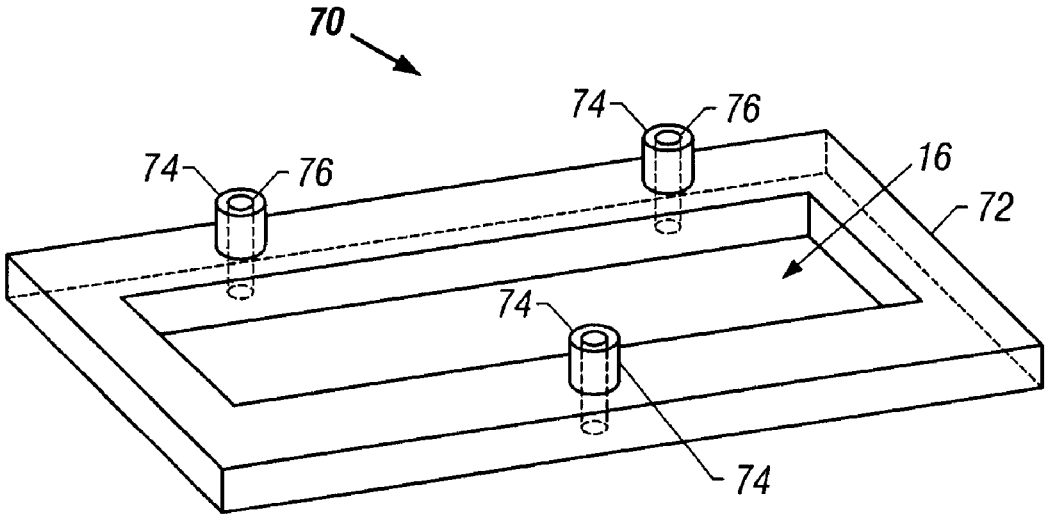
Figure 5:
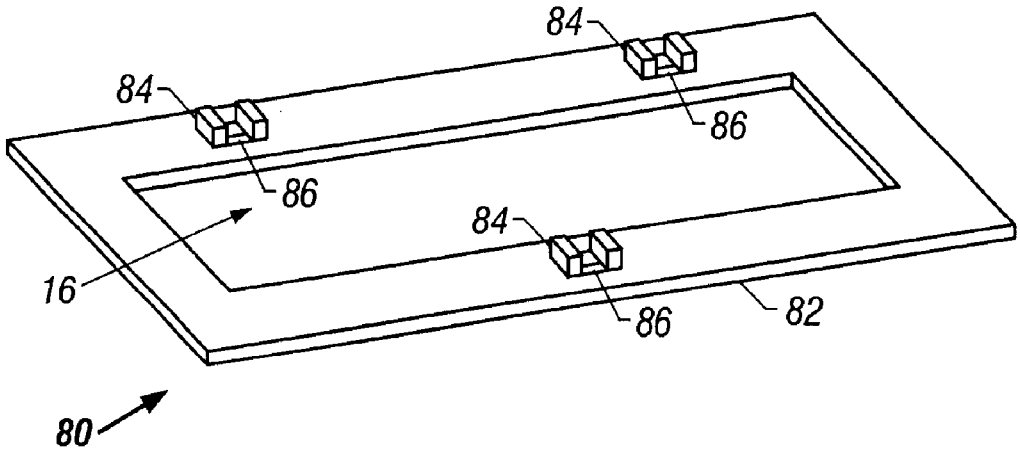

FIG. 1 is a drawing showing a solenoid cradle and solenoid of the present invention;

FIGS. 2A–B are drawings of a mortise lock housing and cover, respectively, having a cradle mounting holes for holding the solenoid cradle of FIG. 1;

FIGS. 3A–D are drawings of electrified mortise locks of the present invention having the solenoid cradle and solenoid of FIG. 1; and FIGS. 4 and 5 illustrate alternative embodiments of the solenoid cradle of FIG. 1.

DETAILED DESCRIPTION OF THE PREFERRED EMBODIMENTS

FIG. 1 illustrates a universal electrified mortise lock kit solenoid cradle of the present invention referred to by the reference number 5. The kit 5 includes a solenoid cradle 10 including a rectangular frame 12 having two or more, preferably three, cradle pins 14 projecting perpendicular to an inner rectangular opening 16 of the frame 12. The kit also includes a solenoid 18. The solenoid cradle 10 and the solenoid 18 are disposed in a mortise lock of the present invention having exemplary embodiments referred to with reference numbers 20A–D (FIGS. 3A–D).

The solenoid 18 has a cylindrical body 22 and an armature 24. There is a threaded hole 26 in the front end of the armature 24. The mortise locks 20A–D are packaged in housings 36A–D (FIGS. 3A–D), respectively. The housings 36A–D include housing covers 38A–D (FIGS. 3A–D), respectively. The solenoid body 22 is embraced by the cradle 10 in the rectangular opening 16, and the cradle 10 and solenoid body 22 are pressed between the body of the housing 36A–D and the cover 38A–D. Cradle pin mounting holes 39 in the body of the housing 36A–D or the cover 38A–D have a pattern matching the pattern of the cradle pins 14. The pins 14 are loosely fit into the pin holes 39 for fixing the cradle 10 in the housing 36A–D and/preventing the solenoid 18 from moving side-to-side or forward-and-back. In a preferred embodiment, the solenoid body 22 has a length of about 1⅝ inches and a diameter slightly smaller than the inside width of 0.7 inches of the housing of a standard mortise lock. For the solenoid 18 having these dimensions, the dimensions of the inner rectangular opening 16 are about 0.6 inches by 1 and ⅝ inches. However, the key aspect of the cradle 10 is that it embrace the solenoid 18 and that the solenoid 18 and the cradle 10 are pressed between the body of the housing 36A–D and the cover 38A–D. The rectangular frame 12 and/or the inner opening 16 may be square.

FIG. 2A is a bottom view of the housing 36A showing the cradle 10, the cradle pins 14 and the cradle mounting holes 39 in an embodiment where the cradle 10 is fixed into body of the housing 36A. FIG. 2B is a top view of the cover 38A showing the cradle 10, the cradle pins 14 and the cradle mounting holes 39 in an embodiment where the cradle 10 is fixed into the cover 38A. The cradle mounting holes 39 may be drilled with an ordinary hand drill using an ordinary drill bit. A tool having guide holes positioned according to the cradle mounting hole pattern may be used for guiding the drill bit. In one embodiment, the pins 14 have diameters to fit into holes 39 drilled by a #50 drill bit. When one of the pins 14 is not needed or has interference, it can be cut off.

FIGS. 3A–D are drawings showing respective exemplary electrified mortise locks 20A–D of the present invention. The mortise locks 20A–D include the cradle 10, the solenoid 18, the housings 36A–D, the covers 38A–D, latches 44A–D and mechanisms 46A–D, respectively. The mechanisms 46A–D and the latches 44A–D are disposed in the housings 36A–D, respectively.

The cradle 10 and the solenoid 18 are assembled into the housing 36A–D for converting a non-electrified mortise lock to the mortise lock 20A–D of the present invention. The mechanism 46A–D includes a hub 48A–D, respectively. A handle 52 (shown in FIG. 3C only) engages the hub 48A–D for driving the mechanism 46A–D. The mechanism 46A–D couples the hub 48A–D to the latch 44A–D. Of course, the handle 52 can have various shapes.

The mechanism 46A–D is biased so that unless some action is taken by the handle 52 (shown in FIG. 3C) or a key override, the latch 44A–D is driven outward from the housing 36A–D in order to hold a door closed. In the unlock condition, turning the handle 52 causes the mechanism 46A–D to retract the latch 44A–D, thereby allowing the door to be opened. In the lock condition, the handle 52 is locked by the mechanism 46A–D so that it cannot turn.

Adapters 54A–D couple the solenoid armature 24 into the mechanisms 46A–D, respectively. The armature 24 has a pull end that pulls toward the solenoid body 22 and a push end, denoted by the reference number 24C (shown in FIG. 3C), that pushes away from the solenoid body 22 when the solenoid 18 is energized. The handle 52 is locked, thereby locking the mortise lock 20A–D, when the adapter 54A–D is engaged into the mechanism 46A–D and unlocked, thereby unlocking the mortise lock 20A–D, when the adapter 54A–D is disengaged from the mechanism 46A–D.

The mortise lock 20A–D can be assembled for fail secure operation or fail non-secure operation. For fail secure operation the mortise lock 20A–D is unlocked when the solenoid 18 is energized and locked when the solenoid 18 is not energized. For fail non-secure operation the mortise lock 20A–D is locked when the solenoid 18 is energized and unlocked when the solenoid 18 is not energized.

The mortise locks 20A, 20B and 20D are shown for fail secure operation with the adapters 54A, 54B and 54D attached to the front (pull) end of the armature 24 using the screw hole 26. The mortise lock 20C is shown for fail non-secure operation with the adapter 54C attached to a back (push) end 24C of the armature 24. However, it should be noted that any of the mortise locks 20A–D can be setup as fail secure or fail non-secure by simply reversing the solenoid 18 in the cradle 10 and attaching the adapters 54A–D to other end of the armature 24 without removing the cradle 10 from the housings 36A–D.

The adapter 54A includes a shaft 60A in line with the armature 24 and an end fitting 62A having a circular cross-section concentric with the shaft 60A. The shaft 60A may be a threaded machine screw. The end fitting 62A attaches at the outboard end of the shaft 60A away from the solenoid 18. The inboard end of the shaft 60A attaches to the armature 24, preferably by threading into the hole 26. The combination of the armature 24, the shaft 60A and the end fitting 62A form a T-shaped latch piece 64A where the end fitting 62A forms the top-line of the "T" and the armature 24 and shaft 60A form the center line.

For the mortise lock 20A, in the non-energized state, for fail secure operation, the solenoid 18 drives the armature 24 so that the latch piece 64A engages the mechanism 46A to lock the mortise lock 20A. When the solenoid 18 is energized it withdraws the latch piece 64A from the mechanism 46A so that the mortise lock 20A is unlocked.

The adapters 54B–D are bar shaped end fittings 62B–D. The fittings 62B–D are preferably about ¼ inches wide (perpendicular to the armature 24 when attached to the armature 24 and parallel to the plane of the inner rectangular opening 16 of the frame 12) by about 1⅛ inches high (perpendicular to the armature 24 when attached to the armature 24 and perpendicular to the inner rectangular opening 16 of the frame 12) by about a range of ⅛ to 1 inch, preferably about ¼ inches, long (in line with the armature 24 when attached to the armature 24). The height of the fitting 62B–D is determined so that the ends of the fitting 62B–D is guided in a slot 66 in the body of the housing 36B–D and a similar opposed slot (not shown) in the cover 38B–D. The combination of the armature 24 and the fittings 62B–D form T-shaped latch pieces 64B–D, respectively, where the fittings 62B–D form the top line of the "T" and the armature 24 forms the center line.

For the mortise locks 20B and 20D in the non-energized state for fail secure operation, the solenoid 18 drives the armature 24 so that the latch pieces 64B and 64D engage jaws of the hubs 48B and 48D to lock the mortise locks 20B and 20D. When the solenoid 18 is energized it withdraws the latch pieces 64B and 64D from the hubs 48B and 48D to unlock the mortise locks 20B and 20D.

For the mortise lock 20C in the non-energized state for fail non-secure operation, the solenoid 18 drives the armature 24 so that the latch piece 64C withdraws from the jaws of the hub 48C to unlock the mortise lock 20C. When the solenoid is energized it drives the armature 24 so that the latch piece 64C engages the jaws of the hub 48C to lock the mortise lock 20C.

The mechanism 46A is representative of a mechanism in a mortise lock available from Schlage Lock Company of Security, Colorado, which is a subsidiary of IR (formerly Ingersoll-Rand) Safety and Security of Bermuda. Elements of the mechanism 46A are described by Hull in U.S. Pat. No. 4,583,382 and by Hensley et al. in U.S. Pat. No. 6,131,966 both of which are incorporated herein by reference. The mechanism 46B is representative of a mechanism in a mortise lock available from Baldwin Hardware Corporation of Reading, Pa. Elements of the mechanism 46B are described by Gokcebay et al. in U.S. Pat. No. 5,228,730 incorporated herein by reference. The mechanism 46C is representative of a mechanism in a mortise lock available from Cal-Royal-Products Inc. of City of Commerce, Calif. The mechanism 46D is representative of a mechanism in a mortise lock available from Corbin Ruslin which is a subsidiary of Yale Security of Charlotte, N.C., which is a part of the Assa/Abloy Group of Sweden. Elements of the mechanisms 46C and 46D are described by Alexander in U.S. Pat. No. 4,118,056 incorporated herein by reference. Even though the present invention is described in terms of four examples referenced as mortise locks 20A–D, the idea of the present invention can be applied for electrifying other mortise locks as well, such as mortise locks available from OSI Security Devices of Chula Vista, Calif.; Security Door Controls of Westlake Village, Calif.; Architectural Control Systems, Inc. of Saint Louis, Mo.; Best Lock Corporation of Indianapolis, Ind.; and Yale Security Incorporated of Charlotte, N.C., and Sargent Lock Company both subsidiaries of the Assa/Abloy Group of Sweden. U.S. Pat. No. 5,474,348 by Palmer et al. incorporated herein by reference shows elements of a mortise lock from Best Lock that may be converted into an electrified mortise lock of the present invention. U.S. Pat. No. 4,950,005 by Cudd incorporated herein by reference shows elements of a mortise lock from Yale Security that may be converted into an electrified mortise lock of the present invention.

A non-electrified mortise lock is converted to an electrified mortise lock by removing parts of the mechanism that are replaced by the frame 10, solenoid 18, and adapter pieces where the adapter pieces are exemplified by pieces 64A–D;

drilling the cradle pin holes 39; installing the cradle 10; placing the solenoid 18 in the cradle; and engaging the armature 24 with an adapter piece in the mechanism.

FIG. 4 illustrates an alternative embodiment of the solenoid cradle 10 of the present invention referred to as a solenoid cradle 70. The cradle 70 includes a rectangular frame 72 analogous to the frame 12 and cradle pins 74 analogous to the pins 14. The frame 70 includes the inner rectangle 16. The cradle pins 74 have axial center bores 76. Cradle pin holes 39 can be drilled by placing the frame 72 in position in the housing 36A–D and then using the center bores 76 as guides for a pilot drill bit for drilling pilot holes. The pilot holes are then drilled out to the full diameter for accepting the pins 74. Preferably, the outside diameter of the pins 74 is about ⅛ inch diameter.

FIG. 5 illustrates another alternative embodiment of the solenoid cradle 10 of the present invention referred to as a solenoid cradle 80. The cradle 80 includes a rectangular frame 82 analogous to the frame 12 and opposed fold pairs 84 analogous to pins 14. The frame 82 includes the inner rectangle 16. An opening 86 is formed between the folds of the fold pairs 84. Preferably the opening 86 is approximately square. Cradle pin holes 39 can be drilled by placing the frame 82 in position in the housing 36A–D and then using the openings 86 as guides for a pilot drill bit for drilling pilot holes. The pilot holes are then drilled out to the full diameter for accepting the fold pairs 84. Preferably, the diagonal of the fold pairs 84 and the holes 88 are about ⅛ inch diameter.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An electrified mortise lock, comprising:

a mortise lock housing having cradle pin holes;

a mechanism disposed in the mortise lock housing, the mechanism coupled to a handle;

a cradle having cradle pins inserted into said cradle pin holes; and a solenoid having a solenoid housing, the solenoid disposed in the cradle, the mortise lock housing pressing the solenoid and the cradle together for retaining the cradle pins in the cradle pin holes for securing the solenoid with respect to the mechanism, the solenoid for controlling the mechanism for alternatively locking or unlocking said handle.

2. The lock of claim 1, wherein:

the cradle includes a frame for framing four sides of an inner rectangular opening for embracing the solenoid; and said cradle pins project perpendicularly from said inner rectangular opening.

3. The lock of claim 1, wherein:

the solenoid is end-for-end reversible without moving the cradle for converting between fail secure and fail non-secure operation.

4. The lock of claim 1, wherein:

the solenoid includes an armature and an adapter for forming a T-shaped latch piece for engaging the mechanism for locking said handle and disengaging from the mechanism for unlocking said handle.

5. The lock of claim 1, wherein:

said cradle pins include axial center bores, respectively.

6. The lock of claim 1, wherein:

said cradle pins are formed of pairs of opposed folds.

7. A mortise lock conversion kit for electrifying a mortise lock having a mortise lock housing, comprising:

a solenoid having a solenoid housing; and a cradle having a frame and cradle pins projecting from said frame, said frame for holding the solenoid, the solenoid and said frame sized for the solenoid and said frame to be squeezed together by said mortise lock housing for retaining said cradle pins in cradle pin holes in said mortise lock housing for securing the solenoid with respect to said mortise lock housing.

8. The kit of claim 7, wherein:

said mortise lock housing disposes a mechanism for coupling a handle to a latch; and said mortise lock housing includes cradle pin holes for accepting said cradle pins and positioning the solenoid for engaging said mechanism for locking said handle.

9. The kit of claim 7, wherein:

said frame frames four sides of an inner rectangular opening for embracing the solenoid; and said cradle pins project perpendicularly from said inner rectangle opening.

10. The kit of claim 7, wherein:

the solenoid is end-for-end reversible without moving said cradle for converting between fail secure and fail non-secure operation.

11. The kit of claim 7, wherein:

the solenoid includes an armature and an adapter for forming a T-shaped latch piece for engaging the mechanism for locking said handle and disengaging from the mechanism for unlocking said handle.

12. The kit of claim 7, wherein:

said cradle pins include axial center bores, respectively.

13. The kit of claim 7, wherein:

at least one of said cradle pins is a pair of opposed folds.

14. A method for making an electrified mortise lock, comprising:

providing a housing having a housing body and a cover for said mortise lock;

providing a mechanism and a latch for said mortise lock, said mechanism for disposal within said housing for coupling a handle to said latch;

providing a solenoid;

providing a cradle having cradle pins having a pattern;

making cradle pin holes in said pattern in said housing;

placing said cradle in said housing with said cradle pins loosely engaged in said cradle pin holes;

placing said solenoid in said cradle;

engaging said solenoid with said mechanism; and covering said housing body with said cover, said housing body and said cover pressing said solenoid and said cradle together for securing said solenoid with respect to said housing by holding said cradle pins in said cradle pin holes.

15. The method of claim 14, wherein:

said cradle includes a frame for framing four sides of an inner rectangular opening for embracing said solenoid; and said cradle pins project perpendicularly from said inner rectangular opening.

16. The method of claim 14, further comprising:

reversing said solenoid end-for-end in said cradle without moving said cradle for converting the mortise lock between fail secure and fail non-secure operation.

17. The method of claim 14, further comprising:

attaching an adapter to an armature of said solenoid for forming a T-shaped latch piece; and wherein:

the step of engaging includes engaging said T-shaped latch piece with the mechanism for locking said handle, said T-shaped latch piece disengaged from the mechanism for unlocking said handle.

18. The method of claim 14, wherein:

the step of making cradle pin holes includes drilling pilot holes guided by center bores in said cradle pins.

19. The method of claim 14, wherein:

at least one of said cradle pins is a pair of opposed folds; and the step of making cradle pin holes includes drilling pilot holes guided by an opening between said opposed folds.

* * * * *